US006485136B1

(12) United States Patent
Shimizu et al.

(10) Patent No.: US 6,485,136 B1
(45) Date of Patent: Nov. 26, 2002

(54) ABSORBER AND CONTAINER FOR INK JET RECORDING LIQUID USING SUCH ABSORBER

(75) Inventors: Eiichiro Shimizu, Yokohama (JP); Hajime Yamamoto, Yokohama (JP); Hiroki Hayashi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/337,547

(22) Filed: Jun. 22, 1999

(30) Foreign Application Priority Data

Jun. 26, 1998 (JP) ..... 10-180449

(51) Int. Cl.[7] ..... B41J 2/175
(52) U.S. Cl. ..... 347/86; 347/87
(58) Field of Search ..... 347/86, 87

(56) References Cited

U.S. PATENT DOCUMENTS

| | | | | |
|---|---|---|---|---|
| 4,515,854 A | * | 5/1985 | Kogame et al. | 442/329 |
| 4,842,796 A | * | 6/1989 | Matsui et al. | 264/203 |
| 5,317,339 A | * | 5/1994 | Braun et al. | 347/87 |
| 5,611,819 A | * | 3/1997 | Nomura et al. | 428/397 |
| 5,623,287 A | | 4/1997 | Saikawa et al. | 347/87 |
| 5,657,065 A | * | 8/1997 | Lin | 347/87 X |
| 5,821,966 A | * | 10/1998 | Schell et al. | 347/86 |
| 5,997,980 A | * | 12/1999 | Matobe et al. | 428/376 |

FOREIGN PATENT DOCUMENTS

| | | |
|---|---|---|
| EP | 562733 | 9/1993 |
| EP | 641660 | 3/1995 |
| EP | 756935 | 2/1997 |
| EP | 771662 | 5/1997 |
| EP | 810096 | 12/1997 |
| EP | 900875 | 3/1999 |
| JP | 7-323566 | 12/1995 |

* cited by examiner

*Primary Examiner*—John Barlow
*Assistant Examiner*—Manish Shah
(74) *Attorney, Agent, or Firm*—Fitzpatrick, Cella, Harper & Scinto

(57) ABSTRACT

A container of the present invention for use of ink jet recording liquid is arranged to store recording liquid to be supplied to an ink jet recording head. This recording liquid container comprises the container main body, and an absorber holding recording liquid contained in the interior of the container main body, and the absorber is constituted by the fiber having its elongation percentage (Japanese Industrial Standard JIS-L1015) of 250% or less. With the elongation percentage of the fibrous absorber manufactured by the thermal processing which is defined within a specific range, it becomes possible to suppress the dimensional changes before and after the execution of the thermal processing, as well as to make the difference smaller between the higher and lower densities on the surface layer and the central portion of the fibrous absorber, respectively, hence providing a highly uniform absorber.

20 Claims, 6 Drawing Sheets

ABSORBER AND CONTAINER FOR INK JET RECORDING LIQUID USING SUCH ABSORBER

BACKGROUND OF THE INVENTION

1. Field of the Invention

The present invention relates to an absorber which is utilized as means for storing ink for use of an ink jet recording apparatus that records by discharging ink, and also, to a container for ink jet recording liquid that uses such absorber. More particularly, the invention relates to an absorber using the fibrous material whose elongation percentage is made within a specific range. The invention also relates to an ink jet liquid container using such absorber.

2. Related Background Art

Conventionally, from the viewpoint of a better ink supply performance for the ink jet recording head, it has been generally practiced to arrange the structure of an ink tank for use of ink jet recording, for adjusting the pressure exerted on the ink which is stored in the ink tank. The pressure thus exerted is termed as the "negative pressure", because this pressure is to make the pressure at the discharge port unit negative against the atmospheric pressure.

As one of the easiest methods for generating such negative pressure, an ink absorber is arranged in the ink tank for the utilization of the capillary force created by the absorber. Particularly, urethane sponge or some other foaming material is used as the ink absorber in consideration of the ease in forming a porous structure having a single hole ratio that presents an excellent ink holding capability. However, the foaming material, such as the urethane sponge, has each of foaming cells separated individually through a membrane in the status of its manufacture as it is, which requires the additional process to remove the membrane to make the urethane sponge usable as the ink absorber. Also, due to the chemical stability and other properties provided for the foaming material itself, there is a fear that an eluted substance is created depending on the kinds of ink that may be used. For that matter, restriction is imposed upon the kind of ink to be used.

In recent years, for the solution of the problems discussed above, it has been proposed to structure the ink absorber with a thermally fused felt which is one of fibrous materials as disclosed in the specification of Japanese Patent Laid-Open Application No. 07-323566.

Nevertheless, the ink absorber formed by thermally fused fibers as disclosed in the specification of the aforesaid patent laid-open application may present considerable changes in the dimension of the outer configuration of the absorber before and after the heat treatment to fuse the fibers themselves by the application of heat. In other words, the contouring dimension of the ink absorber is greatly shrunken after the execution of the heat treatment. If the ink absorber thus shrunken is inserted into the ink tank for use, the dimension of the ink absorber becomes smaller than the inner dimension of the ink tank to make it easier for the ink absorber to move in the ink tank. Then, if, for example, the ink tank is given a shock or the like, the ink absorber is displaced (to shift) in the ink tank to place the ink absorber away from the ink supply port of the ink jet head. As a result, the ink supply performance of the ink jet head is significantly lowered in some cases. Also, if the ink absorber is formed by laminating at least two kinds or more of fibrous blocks, there is a possibility that gaps are formed between the fibrous blocks of the ink absorber after the execution of the heat treatment in some cases. Then, ink is not allowed to move smoothly between the fibrous blocks due to the gaps thus formed, besides those problems discussed above. Therefore, the amount of remaining ink is increased in the ink absorber or the ink supply performance of the ink jet head is remarkably lowered in some cases. Moreover, the ink, which cannot be retained by the ink absorber, tends to reside in the space between the fibrous blocks, and there is a fear that ink leaks out from the ink tank when it is affected by the environmental (atmospheric pressure) changes or shocks that may take place.

SUMMARY OF THE INVENTION

The present invention is designed in consideration of the problems discussed above. It is an object of the invention to provide a thermally fused fibrous absorber which has a smaller heat shrinkage usable as an ink absorber capable of holding in stably and performing ink supply reliably, as well as to provide a container for storing ink jet recording liquid.

The inventors hereof have ardently studied and carried out experiments in order to achieve the aforesaid objectives. As a result, it is ascertained that the elongation percentage of the fiber, which should be used, exerts influences on the status of the absorber after having been thermally fused.

The present invention is based upon such knowledge, and it is characterized in that a fibrous absorber is formed by overlapping fibrous blocks at least a part of which is fused and bonded, and that the fiber that forms this absorber has the elongation percentage (Japanese Industrial Standard JIS-L1015, 1992 and/or 1994 edition) of 250% or less.

Here, it is preferable to satisfy the condition of 0.5 D (denier)$\leqq$A$\leqq$10 D (denier) where the fineness of the fiber constituting the absorber is given as A. Also, it is preferable that given the fibrous length of the fiber constituting the absorber as L, the condition of 10 mm$\leqq$L$\leqq$150 mm is satisfied.

Further, it may be possible to structure the absorber by laminating at least two or more fibrous blocks. Also, it is possible to use the absorber formed by polyolefin fibrous materials most suitably.

Also, in order to achieve the objectives described above, a container of the present invention for use of ink jet recording liquid is arranged to store recording liquid to be supplied to an ink jet recording head. This recording liquid container comprises the container main body, and an absorber holding recording liquid contained in the interior of the container main body, and the absorber is constituted by the fiber having its elongation percentage (Japanese Industrial Standard JIS-L1015) of 250% or less.

In this respect, it is preferable to satisfy the condition of 0.5 D (denier)$\leqq$A$\leqq$10 D (denier) where the fineness of the fiber constituting the absorber is given as A. Also, it is preferable that given the fibrous length of the fiber constituting the absorber as L, the condition of 10 mm$\leqq$L$\leqq$150 mm is satisfied.

Further, it may be possible to structure the absorber by laminating at least two or more fibrous blocks. Also, it is possible to use the absorber formed by polyolefine fibrous materials most suitably.

With the elongation percentage of the fibrous absorber manufactured by the thermal processing being defined within a specific range, it becomes possible to suppress the dimensional changes before and after the execution of the thermal processing, as well as to make the difference smaller between the higher and lower densities on the surface layer and the central portion of the fibrous absorber, respectively, hence providing a highly uniform absorber. Also, it becomes possible to avoid forming the gaps between fibers, thus providing the absorber that may present more stability with respect to the ink supply and holding performance thereof. Furthermore, even for the absorber of such a is type in which a plurality of fibrous blocks are laminated, it becomes possible to provide the absorber having no gaps created by the presence of boundaries that may be peeled off.

With the absorber described above, it is possible to manufacture an container for ink jet recording liquid having an excellent ink supply stability.

BRIEF DESCRIPTION OF THE DRAWINGS

FIGS. 9A, 9B and 9C are views which schematically illustrate one example of a processed fibrous material using the fibers to which the present invention is applicable.

DETAILED DESCRIPTION OF THE PREFERRED EMBODIMENTS

Figure 2:
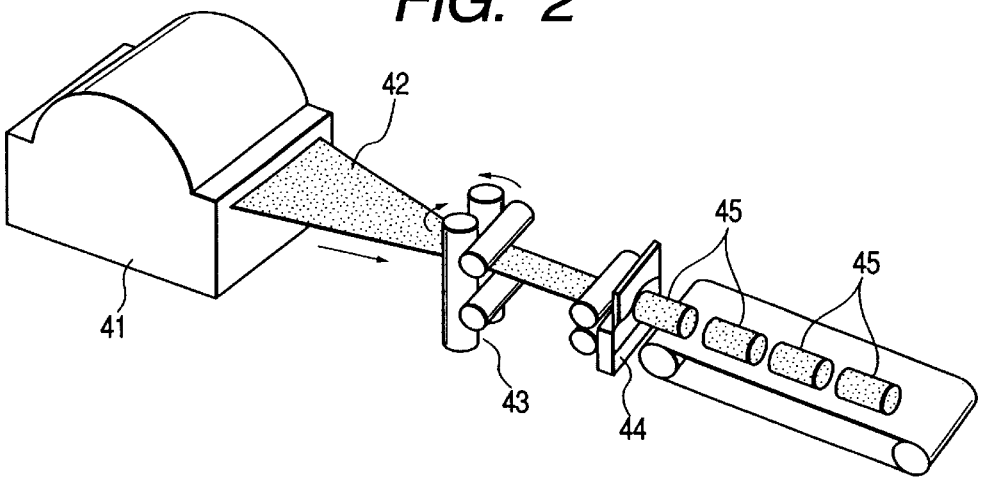
FIG. 2 is a view which schematically shows a manufacturing apparatus to manufacture the fibrous blocks in accordance with the present invention.
Figure 3A:
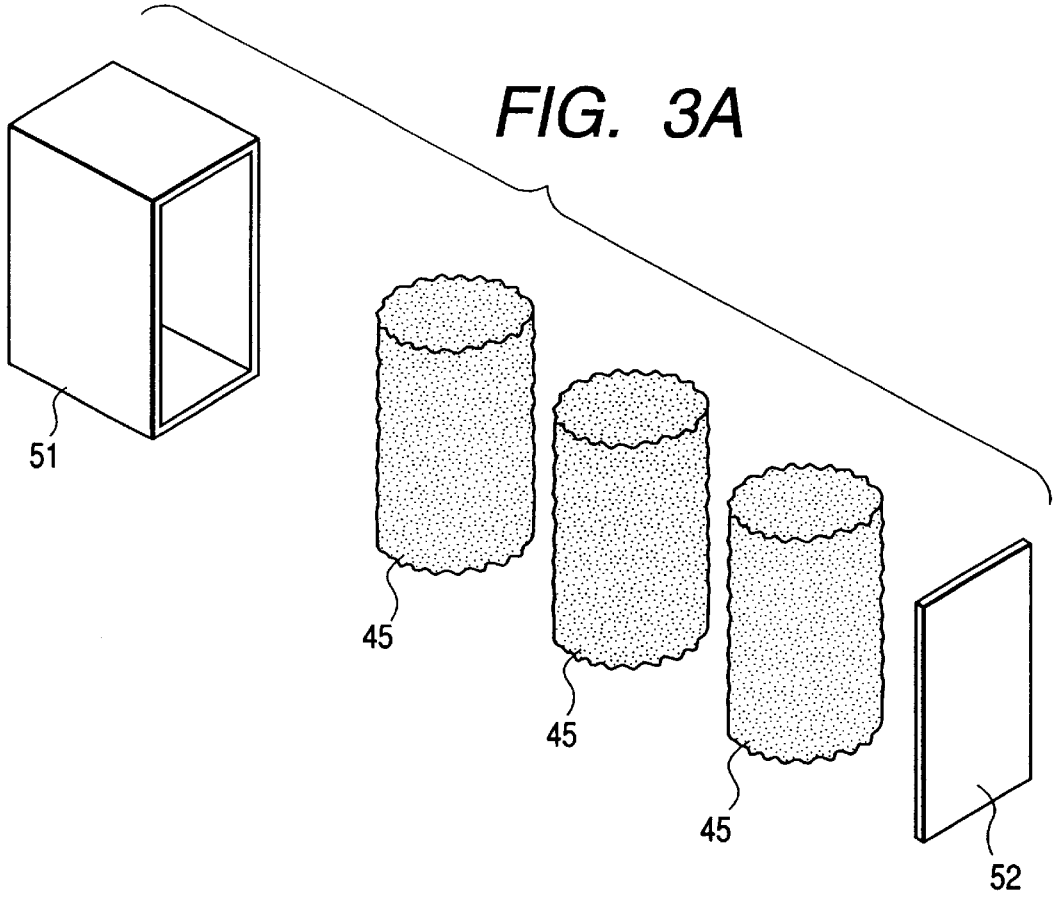
FIGS. 3A and 3B are views which illustrate the method for manufacturing the ink absorber in accordance with the present invention.
Figure 3B:
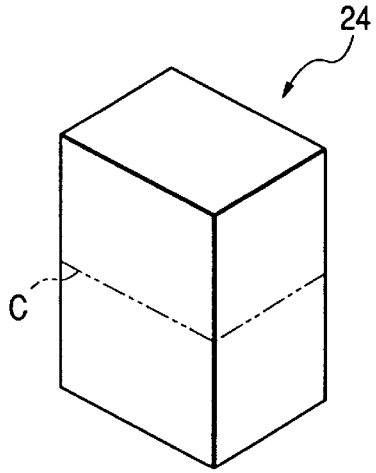

In conjunction with FIG. 2 and FIGS. 3A and 3B, the description will be made of a method for manufacturing an ink absorber to which the present invention is applicable. FIG. 2 is a view which schematically shows the manufacturing apparatus to manufacture the fibrous blocks used for the ink absorber of the present invention. FIGS. 3A and 3B are schematic views which illustrate a method for forming the ink absorber for an ink tank in accordance with the present invention.

At first, an aggregate is formed with continuous fibers in the form of an elastic column or plate. In accordance with the present embodiment, the fabric formed by mixing polypropylene fabric and polyethylene fabric in a ratio of 7 to 3 in terms of weight percentage is processed into a stable sheet type web 42 (in which the directions of fibers are almost arranged in parallel) by use of the card machine 41 shown in FIG. 2 which disentangles the complicatedly entangled fibers. Then, the web 42 is bundled to pass the heat roller 43 to form the continuous fibrous material by thermally bonding the surface layers. In accordance with the present embodiment, the continuous fibrous material is of course an aggregate of short fibers, because the aforesaid card machine is utilized. Here, it is preferable to use a thermoplastic resin as the material to form the fibrous material.

As the thermoplastic resin, there may be used, besides the polypropylene and polyethylene which are mentioned above, polyvinyl chloride, polystyrene, acrylonitrile, polyamide, polyacetal, polyethylene telephthalate, polybutylene telephthalate, polycarbonate, polyphenylene oxide, polyphenylene sulfide, polyether sulfone, polyether ketone, polyether imide, polyamide imide, polysulfone, nylon, and polyimide, among some others. It may be possible to use compounds of these materials or use denatured materials thereof.

With the particular attention given to the storage stability of ink for use of ink jet recording, it is preferable to use the olefinic resin, such as polyethylene or polypropylene as described above.

Now, the temperature of the heat roller 43 may be set at any degree if only it should be higher than the fusion point of the polyethylene fiber, but lower than the fusion point of the polypropylene fiber. However, the temperature should be set lower if the contact time is longer between the fiber and the heat roller, and the temperature should be higher, if the contact time is shorter. For example, if the polyethylene fiber whose fusion point is 132° C. is used, it is preferable to set the temperature of the heat roller at 135° C. to 155° C.

Then, the continuous fibrous material is cut by use of the cutter 44 per standard unit to form each of the fibrous blocks 45. The cutting length should be almost the same as or slightly larger than either one of the side of the mold 51 which is used to form the fibrous black into the ink absorber. When the fibrous block is compressed, it is easier to compress the block in the direction perpendicular to the fibrous direction than the fibrous direction of the block.

The fibrous block 45 on which only the aforesaid surface layer is thermally fused is in a state where cotton having almost the same fibrous direction is wrapped with an unwoven cloth. This surface layer portion has a hardness to the extent that it can be easily handled in the transfer or other automated steps of manufacture, hence making it easier to arrange the manufacturing steps for the ink absorbers, which will be described later. Then, using the aforesaid fibrous blocks the ink absorbers are formed. At first, as shown in FIG. 3A, each of the fibrous blocks 45, having almost the same length as one side of the mold 51, is inserted into the mold 51 formed in a size that includes the anticipated shrinkage at the time of thermal molding. Here, one or more numbers of the fibrous blocks 45 are used depending on the capacity of an ink tank.

As described earlier, since the fibrous block 45 is in a state where the fiber aggregate having the same fibrous orientation is wrapped with an unwoven cloth, the fibrous blocks can fit itself to the configuration of the mold easily.

Subsequently, the lid 52 is installed on the mold 51 after the fibrous blocks 45 are inserted. With this lid 52, the fibrous blocks 45 are in condition of a specific compression.

Then, heating is given by use of a heating furnace to thermally mold the fibrous blocks 45 in the shape of the mold, hence providing the ink absorber as shown in FIG. 3B.

The temperature of the heating furnace can be set at any temperature if it is higher than the fusion point of the polyethylene fiber, but lower than the fusion point of the polypropylene fiber. For example, with the fusion point of the polyethylene fiber being at 132° C., the temperature can be set at 135° C. to 155° C. The heating time can be adjusted in accordance with the required strength.

Now that the polyethylene fibers are fused by the application of heat to function as the bonding agent, the intersection point, at which the polypropylene fibers are entangled three dimensionally, is fixed to provide the strength. Therefore, if a strength is required, it is better to give heat for a comparatively long time until the heat is transferred to the interior completely, although it depends on the configuration of an ink absorber. If flexibility is required, it is better to give heat for a comparatively short period of time so that the heat is not transferred to the interior completely.

As described above, the manufacturing process of an ink tank is divided into the process where the fibrous blocks are formed, and the process where the fibrous blocks are inserted into the mold for the thermal molding. As a result, it becomes easier to form the ink absorbers corresponding to the various inner configurations of ink tanks by changing the molds accordingly. In other words, the mold 51 is prepared to match the inner configuration of the ink tank to be adopted. Then it becomes possible to make the configuration of an absorber almost agreeable with the inner configuration of the ink tank to be used.

Figure 4:
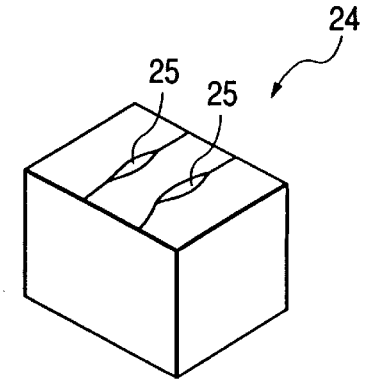
FIG. 4 is a perspective view which schematically shows the gaps created in the interior of an ink absorber.

As described above, the ink absorber formed by laminating a plurality of fibrous blocks is subjected to the creation of gaps in the interior of the ink absorber 24 after it has been thermally molded. FIG. 4 is a sectional perspective view which shows the ink absorber 24 shown in FIG. 3B which is cut along the two-dot chain line C in FIG. 3B. As shown in FIG. 4, the gaps 25 may be created between the fibrous blocks in some cases. Due to such gaps as at 25, the movement of ink is not made smoothly:between the fibrous blocks, which may cause the amount of ink remainders to be increased in the ink absorber 24 or cause the ink supply performance of an ink jet head to be lowered significantly in some cases. Moreover, the ink, which is more than that in an amount to be held in the ink absorber 24, may be retained in the gaps 25, and there is a fear that ink leaks out if the environment (atmospheric pressure) changes or shocks are given.

Figure 5A:
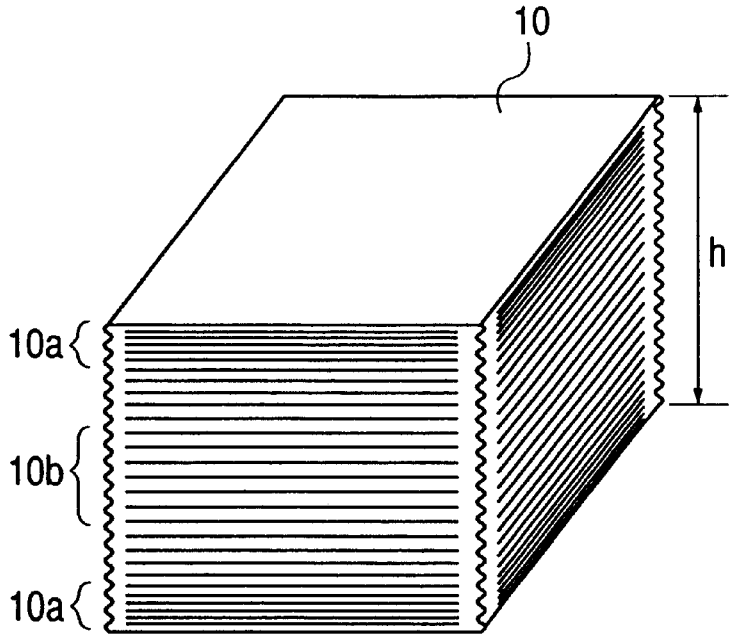
FIG. 5A is a perspective view which schematically shows a portion cut off from the thermally fused felt after processing a fibrous absorber.
Figure 5B:
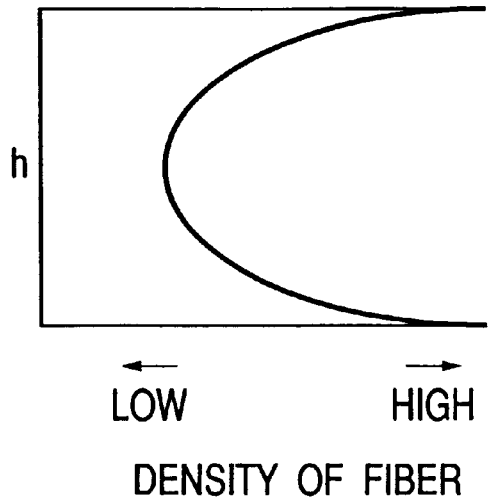
FIG. 5B is a view which shows the density distribution of the laminated layers of fibers in the direction h.

Now, the description will be made of the thermally fused felt produced with the laminated webs 42 which are manufactured by the apparatus shown in FIG. 2, and heated under pressure. FIG. 5A is a perspective view which schematically shows a portion of the thermally fused felt 10 thus obtained. FIG. 5B is a view which shows the density of fibers of the thermally fused felt 10 in the direction h of the fibrous lamination thereof. In this respect, the thermal fused felt 10 is heated in the top to bottom direction in FIG. 5A.

As shown in FIGS. 5A and 5B, the thermally fused felt 10 obtained through the heating process has the different densities of fibers on the surface layer portion 10*a* and in the central portion 10*b*. The surface layer portion 10*a* is in the condition of comparatively high density, and the central portion 10*b* is in the condition of comparatively low density.

As described above, the high and low density conditions of fibers are created in the thermally fused felt 10. Conceivably, this is because of the difference in the heat transfer on the surface layer portion and the central portion when the heat is given in the heating process. In other words, the heat is directly transferred to the surface layer portion 10*a*, and it is allowed to reach the fusion point of the bonding component of the fiber, while the heat is not easily transferred in the central portion 10*b* as compared with the surface layer portion due to the heat insulation effect of the felt.

Also, together with the fusion of the bonding component, the fibers on the surface layer portion 10*a* tend to make its own fibrous elasticity lower as the softening of the skeleton fibers advances. However, it takes longer for the fibers on the central portion to transfer heat as described above. Then, it also takes longer to make the elasticity of its own fibers lower as compared with the surface layer portion. As a result, with such elasticity of the fibers on the central portion, the fibers are pushed to the surface layer portion eventually, hence creating the difference in the fibrous density between the surface layer portion 10*a* and the central portion 10*b*.

Further, the elongation percentage of fibers taken up in the present invention also exerts a great influence on the determination of the amplitude of the difference in the fibrous densities. It has been discovered that even for the absorbers having the same fibrous density, the greater the elongation percentage of the fiber, the lower becomes the fibrous density, and that it becomes easier to create gaps 25 as shown in FIG. 4 on the central portion where the fibrous density tends to be lowered. This is because the greater the elongation percentage, the greater becomes shrinkage of the fibers themselves at the time of heating. Here, for the fibrous block, which is prepared by mixing the polypropylene fiber and the polyethylene fiber in a ratio of 7 to 3 in terms of the weight percentage as described earlier, the polyethylene fiber functions to serve as the bonding material. In this case, therefore, the elongation percentage of the fiber is that of the polypropylene fiber which is used as the framework material of the fibers. Here, the elongation percentage is measured by the method regulated by the Japan Industrial Standard JIS-L1015.

Figure 6:
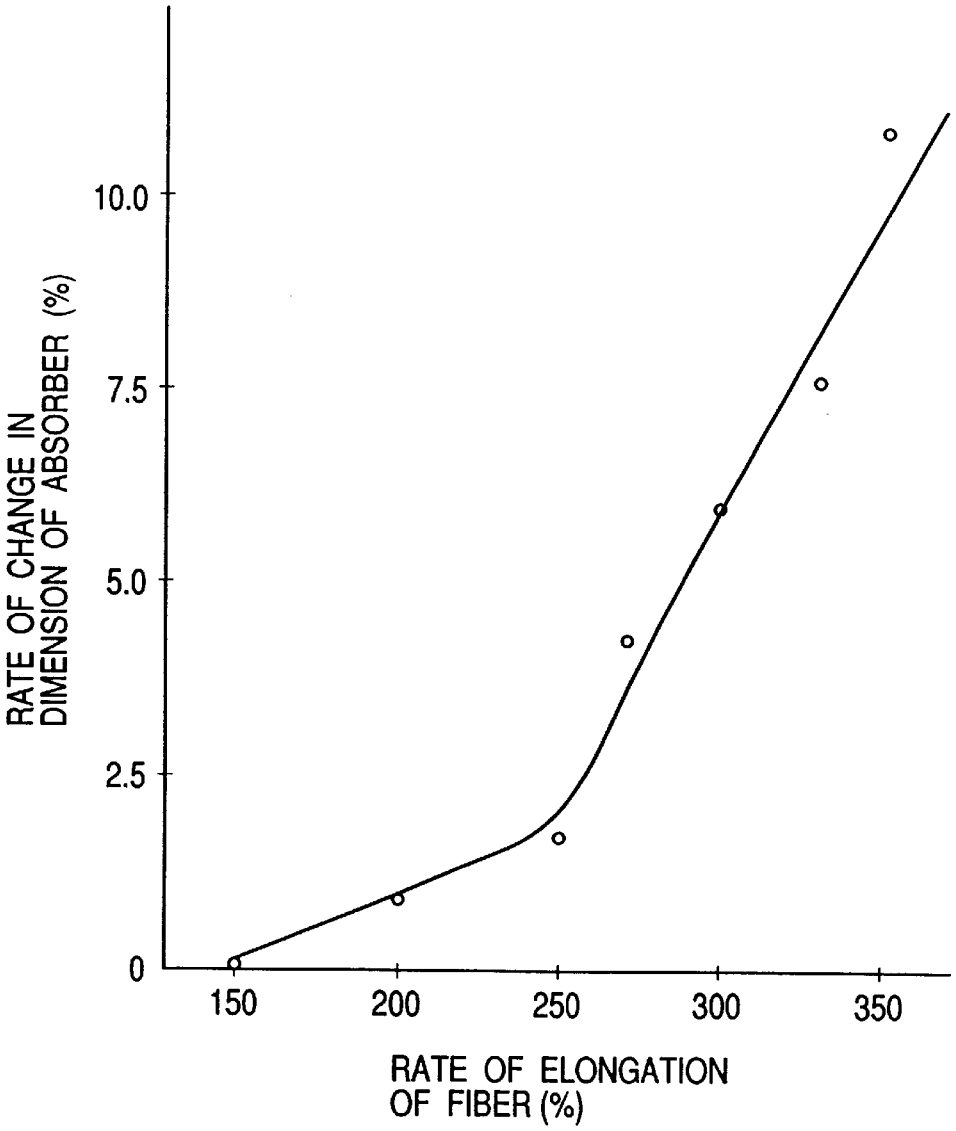
FIG. 6 is a graph which shows the relationship between the elongation percentage and the ratio of dimensional changes.

In this respect, the measurements are made to ascertain the relationships between the elongation percentages and the dimensional changes of the absorbers. The measurements are carried out in such a manner that the elongation percentage of fibers is appropriately selected within a range of 150% to 350%, and then, the dimensional changes are indicated as the rate of changes in the dimension of the absorber with the 150% elongation of fiber as a criterion. The results are shown in FIG. 6. As clear from FIG. 6, the rate of the dimensional changes becomes greater as the elongation percentage becomes larger. The inclination of line that indicates the dimensional changes between the 150% and 250% differs greatly from the inclination of line that indicates the dimensional changes between the 250% and 350%.

Figure 1:
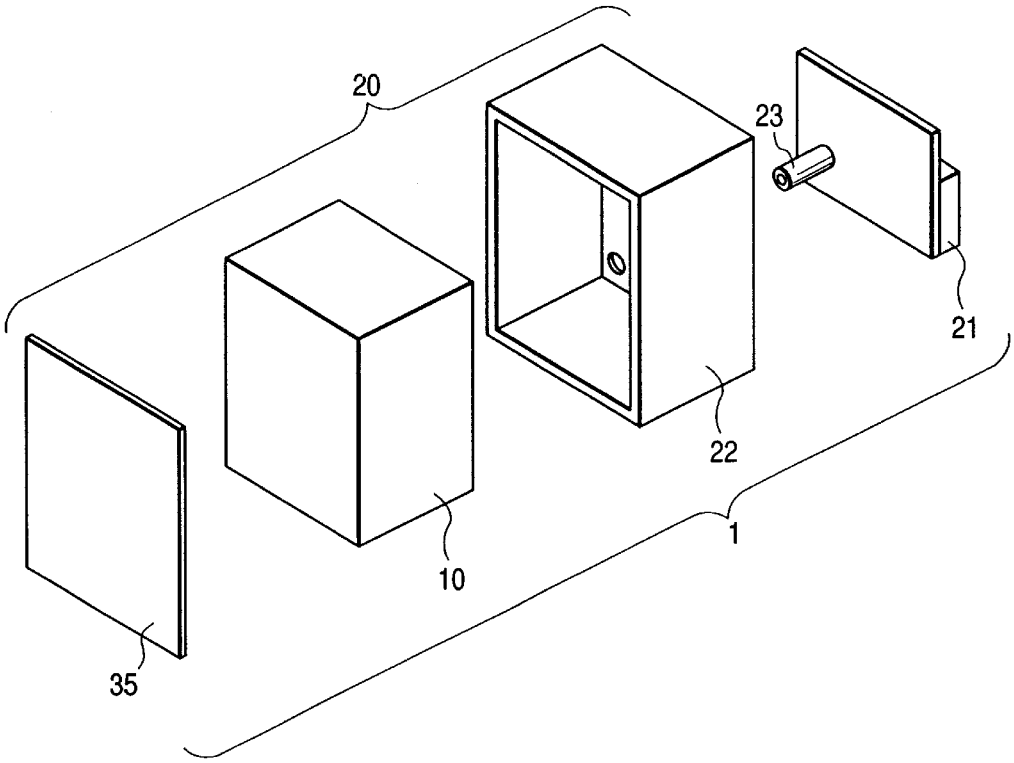
FIG. 1 is an exploded perspective view which shows the ink jet cartridge provided with the ink absorber and ink tank to which the present invention is applicable.

Now, with this result in view, ink absorbers are produced by use of the fibers having each of the elongation percentages, respectively. The ink jet cartridge that uses the ink absorber thus produced is illustrated in FIG. 1 as an exploded perspective view.

The ink jet cartridge 1 comprises the ink jet head 21 that discharges ink; and the ink tank 20 detachably mountable on the ink jet head. The ink jet head 21 is connected with the ink tank 20 through the ink supply tube 23, and ink is supplied to the ink jet head 21 by way of the ink supply tube 23. The ink tank 20 contains the ink absorber 10 in the interior of the recessed type container 20 that constitutes a housing together with a lid member 35, thus holding ink in the absorber. For the ink tank, an atmospheric communication unit (not shown) is provided so that the interior of the housing is communicated with the air outside.

The ink absorber 10, which is retained in the area surrounded by the housing of the ink tank (hereinafter referred to as the interior of the housing or the retaining portion of the ink absorber), is formed by the thermally molded fibrous block produced by compressing the fibers mixed with the polypropylene fiber and polyethylene fiber in a ratio of 7 to 3 in terms of the weight percentage to match the inner configuration of the ink tank. The temperature of the thermal molding may be set at any degree if only it is higher than the fusion point of the polyethylene fiber and lower than the fusion point of the polypropylene fiber. In accordance with the present embodiment, the thermal molding is carried out at a temperature of 155° C.

The outer appearance of the fibrous absorber is inspected by eye sight before it is inserted into the container that constitutes the ink cartridge, thus confirming whether or not any gaps are created. At the same time, the examination is made on the resistance to shocks and the inserting performance by preparing the ink cartridge with the container having the fibrous absorber thus produced inserted into it. Here, although not shown on the Table 1 given below, the formation of any gaps is not recognized on the outer appearance of the fibrous absorbers before being inserted into its container with respect to any one of the samples listed on the Table. The resistance to shocks is determined by the evaluation of ink supply performance after dropping the cartridge thus prepared from the height of one meter. Then, those having no influence at all are marked with ○; slightly affected, with Δ; and the affected one, with ×. The inserting performance is determined by the outer appearance of the gaps between the absorber and the inner surface of the container, which are created when the absorber is inserted into the container at the time of the ink tank assembly, and then, it is indicated as given below: those inserted in good condition without any gaps are marked with ○; slight gaps, with Δ; obvious gaps, with ×. As to the creation of gaps, the respective absorbers are cut and whether or not there are any gaps 25 on the central portion is confirmed by eye-sight as described earlier.

The inspection samples are prepared for each of the elongation percentages of 150%, 200%, 250%, 275%, and 300%, respectively. The results are shown on the Table 1.

TABLE 1

| | Elongation percentages % | Resistance to shocks | Inserting performance | Gap creations (occurrance) |
|---|---|---|---|---|
| Sample 1 | 150 | 0 | 0 | None |
| Sample 2 | 200 | 0 | 0 | None |
| Sample 3 | 250 | 0 | 0 | None |
| Sample 4 | 270 | Δ | Δ | Slight |
| Sample 5 | 300 | x | x | Apparent |

As clear from the Table 1, the creation of any gaps is not recognized on the fibrous absorbers thus produced for the samples No. 1 to No. 3. Also, good results are obtained for them as to the resistance to shocks and inserting performance thereof. On the contrary, for the sample No. 4, any one of the properties is not very good, and the gaps are recognized slightly on the absorber. As to the sample No. 5, the gaps are apparently recognized on the fibrous absorber. Also, with a greater shrinkage of the absorber, there is ink leakage recognized, because the fibrous absorber moves in the container when resistance to shocks is examined. Also, as to the inserting performance, gaps take place between the absorber and the container. Thus, it is impossible to obtain good results as the absorber that constitutes the ink cartridge.

In accordance with each of the embodiments described above, the polypropylene fiber and polyethylene fiber are mixed in a ratio of 7 to 3 in terms of the weight percentage to prepare the fibers to be used. However, those which may be utilized are not necessarily limited to them. As described earlier, the ratio of the combination of fibers, and that of mixture thereof are arbitrarily adjustable.

However, in consideration of the liquid contact performance (storage stability) with respect to ink for use of ink jet printing, it is preferable to form the absorber with the polyolefine materials. Then, if any label is provided for the identification of the product, it is also preferable to form such label with the same material.

Now, the fibrous elongation percentage which is taken up for designing the present invention is the factor related to the temperature of thermal process of fibers, and the fibrous materials to be used, particularly to the fusion point of the fibrous material to be used as the framework material. In other words, the softening shrinkage of the fiber is not very large if the fusion point of the fiber is extremely high as the framework material with respect to the temperature of the thermal processing thereof. There is no essential influence to be exerted. In contrast, if the fusion point of the fiber as the framework material is comparatively closer to the temperature of the thermal processing thereof, the fiber is softened to bring about more shrinkage. Then, it is subjected to the influence of the elongation percentage.

For example, if the fusion point of the fiber to be used as the framework material is higher than the thermal processing temperature by 100° C. or more, there is no essential influence on the shrinkage of fiber. If the fusion point is 100° C. or less, the influence should be taken into consideration.

Figure 7:
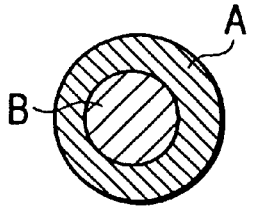
FIG. 7 is a cross-sectional view which shows one example of the fibrous material to which the present invention is applicable.

Also, as to the mode of fibers to be used for the present invention, it is of course possible to apply the invention to the case where the fiber, which is formed integrally with different kinds of materials, is used. For a fiber of the kind, there is the so-called double axes fibrous material, which is formed as shown in FIG. 7, for example, with polypropylene functioning as the framework material for its core portion, and with polyethylene function as the bonding material on the circumference (sheath portion) thereof. In accordance with this structure, it is possible to use the polypropylene and polyethylene within a range of voluminal ratio of 40:60 to 60:40(%).

In a case of the double axes fiber, it should be good enough if only the elongation percentage is within the range defined by the present invention in the mode of the double axes fiber as it is.

Also, when the fibrous block is formed, it may be possible to arrange the mixing structure of fibers so that the double axes fiber of the polypropylene and polyethylene is allowed to function as the bonding material, while the single fiber using polypropylene is used as the framework material. In this case, although depending on the ratio between the double axes fiber and the single fiber, it should be good enough if only the elongation percentage of the single polypropylene fiber is within its range of the present invention.

In other words, when a plurality of fibers are mixed to from a fibrous block, there is no need for essentially considering the elongation percentage of the fiber to be used as the bonding material, because the mixing ratio of the fiber that should be used as the bonding material is not allowed to be too high in consideration of the maintenance of the performance of the absorber per se. It is of course unnecessary to consider essentially the elongation percentage for the double axes fiber as described above even in the mode where the double axes fiber is used as the bonding material. However, if consideration should be given to the control of the shrinkage of the fibrous block more strictly, it is preferable to define the elongation percentage of the double axes fiber within the regulated range of the present invention even if it is used as the bonding material.

In addition, for each of the embodiments described above, the fibers having its fineness of 6 D (denier), and the fibrous length of 60 mm are used, and the examination is carried out with the fibrous density of approximately 0.1 g/cm$^3$.

In accordance with another study made by the inventors hereof, it has become clear that the fibers used as the ink absorber to which the present invention is applicable should preferably be of 0.5 D to 10 D of fineness and 10 mm to 150 mm long in consideration of the characteristics of the ink absorber (such as the ink holding and ink supply performances, and reliability, among some others).

When the absorber of an ink tank is manufactured using the material within the range of the elongation percentage as described above, it is of course possible to adopt the metallic mold 51 used for the thermal processing which is configured substantially equal to the inner configuration of the ink tank to be used.

Figure 8:
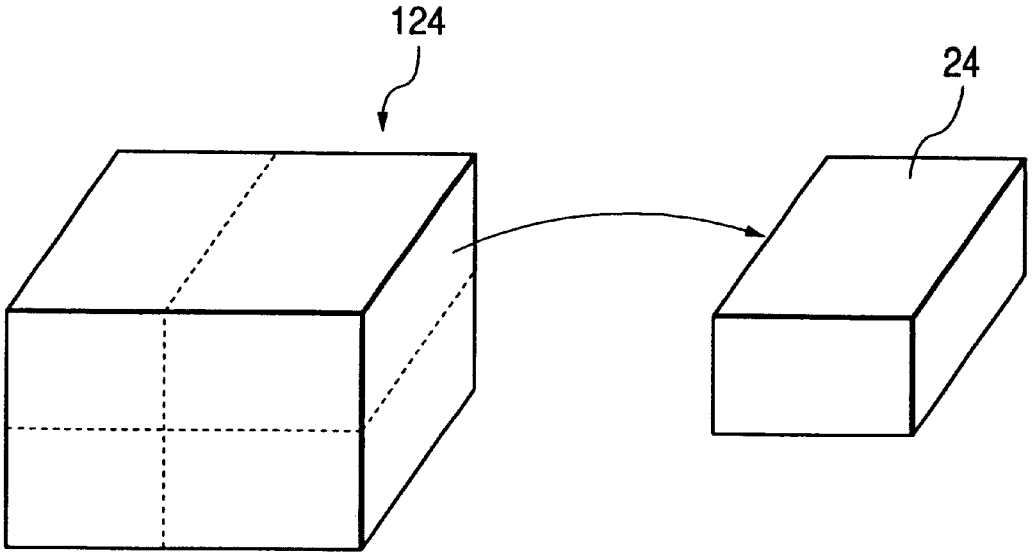
FIG. 8 is a view which schematically shows the state in which smaller blocks are processed from a larger block.
Figure 9A:
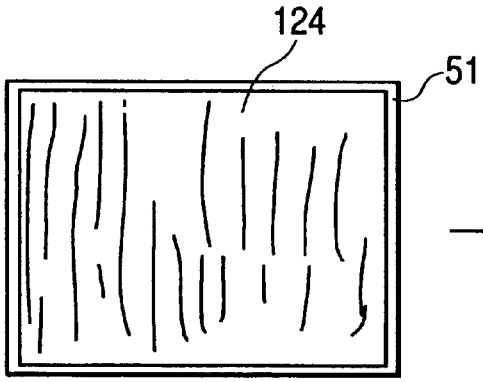
Figure 9A:
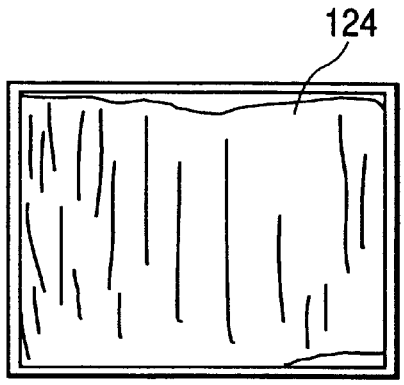
Figure 9C:
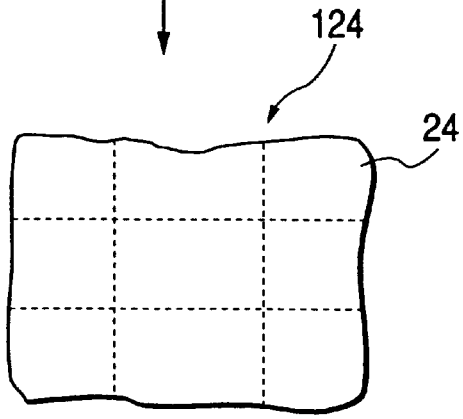

However, the present invention is not necessarily limited to this arrangement, but it may be possible to use a large metallic mold for molding a large black absorber 124 as shown in FIG. 8 or FIGS. 9A to 9C, and then, to cut it into a plurality of smaller blocks to be fitted into the inner configuration of an ink tank, hence obtaining each of the absorbers 24, which is contained in the ink tank accordingly. Here, FIG. 9A is a cross-sectional view which shows the state where the fiber is contained in the metallic mold 51 before the thermal processing. FIG. 9B is a cross-sectional view which shows the state where the absorber 124 is molded in the metallic mold 51 after the thermal processing. FIG. 8 and FIG. 9C are the schematic views which illustrate the block absorber 124 drawn out from the metallic mold 51.

In other words, if the elongation percentage of a fibrous material exceeds a specific range, the outer circumference of the absorber 124 is deformed as shown in FIG. 9C or gaps or the like is formed in the interior of the absorber in the metallic mold even if a large block absorber 124 is molded. Therefore, when the large block absorber is cut into a plurality of smaller absorbers 24, those on the outer circumferential portion cannot be used or those may become the absorbers having gaps in them, hence making it impossible to obtain stabilized absorbers eventually.

In this respect, the large block absorber may be structured to be the one like a metallic mold whose six faces are enclosed. However, only with two faces which are sandwiched by flat plates, a fibrous absorber may be manufactured by the thermal processing or some other generally known processing methods are of course applicable to the manufacture of the fibrous absorber.

As to the structural examples of the fibrous blocks described above, the mode, in which the fiber formed by a single materials the framework material is mixed with the fiber serving as the bonding material (irrespective of the single fiber or the double axes fiber), may present the irregular conditions of dispersion of the bonding fiber at the stage of mixing it with the other fiber. As a result, the fibrous block is molded eventually in the bonding conditions which are locally different. In contrast, if double axes fibers are used for molding the fibrous blocks, no irregular conditions may be caused for the bonding material. As a result, the fibrous blocks are processed uniformly as a whole to enable this mode to be regarded as a more preferable one.

Now that the elongation percentage of the fibrous absorber manufactured by the thermal processing has been defined within a specific range, it becomes possible to suppress the dimensional changes before and after the execution of the thermal processing, as well as to make the difference smaller between the higher and lower densities on the surface layer and the central portion of the fibrous absorber, respectively, hence providing a highly uniform absorber. Also, it becomes possible to avoid forming the gaps between fibers, thus providing the absorber that may present more stability with respect to the ink supply and holding performance thereof. Furthermore, even for the absorber of such a type in which a plurality of fibrous blocks are laminated, it becomes possible to provide the absorber having no gaps created by the presence of boundaries that may be peeled off.

With the absorber described above, it is possible to provide a container for ink jet recording liquid having an excellent ink supply stability.

What is claimed is:

1. A fibrous absorber for a liquid to be housed in a container storing the liquid, said fibrous absorber comprising a fibrous aggregate arranged by aggregating a plurality of fibers, applying heat to fuse a part of the fibers, and bonding parts of the fibers, wherein each fiber of the fibers constituting said fibrous aggregate satisfies a condition that an elongation rate (JIS-L1015) before processing is equal to or less than 250%.

2. An absorber according to claim 1, wherein given the fineness of a fiber constituting said fibrous aggregate as A, the condition of the 0.5 D (denier)$\leqq$A$\leqq$10 D (denier) is satisfied.

3. An absorber according to claim 1, wherein given the length of a fiber constituting said fibrous aggregate as L, the condition of 10 mm$\leqq$L$\leqq$150 mm is satisfied.

4. An absorber according to claim 1, wherein said absorber is constituted by laminating two or more fibrous aggregate.

5. An absorber according to claim 1, wherein said absorber is constituted by polyolefin fibers.

6. A container for use in ink jet recording to store recording liquid to be supplied to an ink jet recording head the container comprising:

a container main body; and a fibrous absorber in said container main body for holding said recording liquid, wherein said fibrous absorber comprises a fibrous aggregate arranged by aggregating a plurality of fibers, applying heat to fuse a part of the fibers, and bonding parts of fibers, wherein each fiber of the fibers constituting said fibrous absorber satisfies a condition that an elongation rate (JIS-L1015) before processing is equal to or less than 250%.

7. A container for use in ink jet recording according to claim 6, wherein given a fineness of the fiber constituting said fibrous aggregate as A, the condition of 0.5 D (denier)$\leqq$A$\leqq$10 D (denier) is satisfied.

8. A container for use in ink jet recording according to claim 6, wherein given the length of a fiber constituting said fibrous aggregate as L, the condition of 10 mm$\leqq$L$\leqq$150 mm is satisfied.

9. A container for use in ink jet recording according to claim 6, wherein said absorber is constituted by laminating two or more fibrous aggregates.

10. A container for use in ink jet recording according to claim 6, wherein said absorber is constituted by polyolefin fibers.

11. An absorber according to claim 4, wherein during formation said absorber is contained in a mold of a specific configuration, and thermally processed to a specific configuration by application of heat.

12. An absorber according to claim 11, wherein said mold has a configuration equal to an inner configuration of an ink tank to contain said absorber, and the absorber is formed by the thermal processing substantially along the inner configuration of the ink tank.

13. A container for use in ink jet recording according to claim 9, wherein during formation said absorber is contained in a mold of a specific configuration, and thermally processed to a specific configuration by application of heat.

14. A container for use in ink jet recording according to claim 13, wherein said mold has a configuration equal to an inner configuration of said container main body, and the absorber is formed by the thermal processing substantially along the inner configuration of said container main body.

15. An absorber according to claim 1, wherein said absorber is cut after thermal molding in order to obtain a plurality of smaller blocks.

16. An absorber according to claim 15, wherein said thermal molding is made in a mold.

17. An absorber according to claim 15, wherein said thermal molding is made by sandwiching the absorber between two flat plates under heating environment.

18. A container for use in ink jet recording according to claim 6, wherein said absorber is cut after thermal molding in order to obtain a plurality of smaller blocks.

19. A container for use in ink jet recording according to claim 18, wherein said thermal molding is made in a mold.

20. A container for use in ink jet recording according to claim 18, wherein said thermal molding is made by sandwiching the absorber between two flat plates under heating environment.

* * * * *

UNITED STATES PATENT AND TRADEMARK OFFICE

CERTIFICATE OF CORRECTION

PATENT NO. : 6,485,136 B1
DATED : November 26, 2002
INVENTOR(S) : Eiichiro Shimizu et al.

It is certified that error appears in the above-identified patent and that said Letters Patent is hereby corrected as shown below:

Column 3,
Line 5, “a is type” should read -- a type --; and
Line 10, “an container” should read -- container --.

Column 5,
Line 30, “smoothly: between” should read -- smoothly between --.

Column 9,
Line 55, “materials the” should read -- materials as the --.

Column 10,
Line 36, “aggregate.” should read -- aggregates. --; and
Line 40, “head” should read -- head, --.

Signed and Sealed this

Eighth Day of July, 2003

JAMES E. ROGAN
*Director of the United States Patent and Trademark Office*